US010252395B2

(12) United States Patent
Palmieri et al.

(10) Patent No.: US 10,252,395 B2
(45) Date of Patent: Apr. 9, 2019

(54) CERAMIC COATING POLISHING METHOD

(71) Applicant: UNITED TECHNOLOGIES CORPORATION, Farmington, CT (US)

(72) Inventors: Bartolomeo Palmieri, Guilford, CT (US); John P. Rizzo, Jr., Vernon, CT (US); Kaitlin M. Tomeo, Middletown, CT (US); Alan C. Barron, Jupiter, FL (US); Christopher J. Millea, Coventry, CT (US); Henry H. Thayer, Wethersfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 315 days.

(21) Appl. No.: 14/623,351

(22) Filed: Feb. 16, 2015

(65) Prior Publication Data

US 2017/0014968 A1 Jan. 19, 2017

(51) Int. Cl.
*B24B 29/00* (2006.01)
*B24B 19/14* (2006.01)
(Continued)

(52) U.S. Cl.
CPC ..... *B24B 29/005* (2013.01); *B24B 19/14* (2013.01); *B24B 27/0038* (2013.01);
(Continued)

(58) Field of Classification Search
CPC ..... B24B 19/14; B24B 29/005; B24B 29/02; B24B 29/06; B24B 49/16; F01D 5/288;
(Continued)

(56) References Cited

U.S. PATENT DOCUMENTS 4,055,705 A 10/1977 Stecura et al.
4,914,872 A * 4/1990 Snyder et al. ..... B24B 19/14 451/401

(Continued)

FOREIGN PATENT DOCUMENTS

| | | | |
|---|---|---|---|
| EP | 1088908 | A1 | 4/2001 |
| EP | 1284337 | A1 | 2/2003 |
| EP | 2740568 | A2 | 6/2014 |
| WO | 2014035413 | A1 | 3/2014 |

OTHER PUBLICATIONS

EP SR, Issued Jul. 11, 2016, U420895EP.

*Primary Examiner* — Timothy V Eley
(74) *Attorney, Agent, or Firm* — Cantor Colburn LLP

(57) ABSTRACT

A method of polishing an outer surface of a ceramic coated gas turbine engine component includes applying a rotating diamond brush to the outer surface. The brush is configured to achieve a uniform finish of 150 microinches $R_a$ or less over the surface. The brush contains diamond impregnated bristles, and is affixed to a rotary head of a robotic arm. A force sensing controller limits brush forces against the component. The component disclosed is a hot section turbine vane designed for directional control of high temperature, high-pressure combustion gases, but the method may be applied to other components contained within such aerospace applications. The polished coating provides an improved thermal barrier for maintaining structural integrity of the component in environments having temperatures ranging up to 2,000 degrees Celsius. The method limits abrasive removal of ceramic material to only 0.0005 to 0.00075 inch, and saves time and expense over past practices.

18 Claims, 2 Drawing Sheets

(51) Int. Cl.

| | |
|---|---|
| ***B24B 27/00*** | (2006.01) |
| ***B24B 49/16*** | (2006.01) |
| ***C23C 4/18*** | (2006.01) |
| ***F01D 5/28*** | (2006.01) |
| ***F01D 9/02*** | (2006.01) |

(52) U.S. Cl.
CPC ..... *B24B 49/16* (2013.01); *C23C 4/18* (2013.01); *F01D 5/288* (2013.01); *F01D 9/02* (2013.01); *F05D 2220/323* (2013.01); *F05D 2230/90* (2013.01); *F05D 2300/20* (2013.01)

(58) Field of Classification Search
CPC ..... F05D 2220/323; F05D 2230/90; F05D 2300/20
See application file for complete search history.

(56) References Cited

U.S. PATENT DOCUMENTS

| | | | | |
|---|---|---|---|---|
| 6,180,260 | B1 | 1/2001 | Gray et al. | |
| 6,652,918 | B1 * | 11/2003 | Lee | B01D 57/02 427/255.27 |
| 6,773,753 | B2 * | 8/2004 | Anderson | F01D 5/145 416/241 B |
| H2285 | H * | 9/2013 | Trzcinski | 451/5 |
| 2004/0072508 | A1 * | 4/2004 | Lee | B01D 57/02 451/41 |
| 2011/0244759 | A1 * | 10/2011 | Sutton | A61F 2/30767 451/5 |
| 2012/0190272 | A1 | 7/2012 | Trzcinski et al. | |
| 2017/0014968 | A1 * | 1/2017 | Palmieri | B24B 19/14 |

* cited by examiner

CERAMIC COATING POLISHING METHOD

FIELD OF DISCLOSURE

The present disclosure generally relates to polishing ceramic coated components subjected to high temperatures and pressures, and particularly to such components for use in gas turbine engines.

BACKGROUND OF DISCLOSURE

A modern turbojet gas turbine engine typically includes a bypass air fan section, and a separate central engine core consisting of a compressor, at least one combustor, and a turbine. The bypass air fan section, situated at an axially forward end of the engine, comprises a rotatable hub, an array of fan blades projecting radially from the hub and a fan casing encircling the blade array. In operation, the fan section forces a major portion of its received air around the central engine core, and the balance of the air into a flow passage leading to an axial compressor. The portion of the air passing through the compressor is pressurized, then directed into the combustor. Fuel is continuously injected into the combustor together with the compressed air. The mixture of incoming fuel and air is ignited to create combustion gases that enter a combustion section of the rotatably driven turbine. As a result, high temperature, high pressure combustion gases expand rapidly over rotating blades and static vanes of the turbine. Since the turbine is connected to the compressor via a shaft, the combustion gases that drive the turbine also drive the compressor to maintain continuous operation of the engine.

The turbine vanes in the combustion section of a gas turbine engine are fixed in place within a so-called "hot section" of the engine, and may be subject to an environment having temperatures that range up to 2,000 degrees Celsius. Although the base metals of such vanes are generally formed of super alloys including cobalt or nickel, the working surfaces of the vanes are typically coated with ceramic to assure longevity under harsh operating conditions. The finished surfaces of the ceramic coatings must be extremely smooth and micro-crack free to perform at optimal levels.

Ceramic coatings are normally applied to outer base metal surfaces of the components via plasma spray techniques that are well known in the art. Machining operations required to smooth out and hence finish the ceramic surfaces have involved using mixtures of abrasive stone particles in water baths. Such mixtures are vibrated, often within bowls containing pluralities of the ceramic coated components desired to be finished. The stone particles are available in a variety of sizes and shapes, some having average diameters on the order of up to 0.5 inch, depending on the desired smoothness and length of vibratory exposure time.

The approach involves a relatively messy slurry bath, to the extent that water and/or other liquid media are used for greatest effectiveness in polishing exterior surfaces of the coated ceramic. Significant cleanup is required between batches, as well as replacement of the abrasive stone particles as they become reduced in size due to wear. A further disadvantage has been an inability to achieve surface finishes having roughness averages of less than 150 microinches. Thus, in some instances, the polished surfaces may not become as smooth as desired.

To better achieve current ceramic surface smoothness demanded by the turbojet gas turbine industry to produce even more reliable high-performance turbine engines, it is therefore desirable to provide improved machine processing methods having lower costs and shorter time requirements.

SUMMARY OF DISCLOSURE

In accordance with one aspect of the present disclosure, a method of polishing an exterior surface of a ceramic coated outer layer on a gas turbine engine component is disclosed. The method includes robotically applying a diamond impregnated brush to the exterior surface, the brush configured to achieve a finish of 100 microinches $R_a$ or less on the exterior surface.

In accordance with another aspect of the present disclosure, the brush has diamond impregnated bristles affixed to a rotary head.

In accordance with another aspect of the present disclosure, the brush is positioned on a robotic arm, and the arm is subject to a force sensing controller.

In accordance with yet another aspect of the present disclosure, the component is an airfoil including vanes, and the coating provides a thermal barrier for maintaining integrity of the component in an environment having temperatures ranging up to 2,000 degrees Celsius.

In accordance with a still further aspect of the present disclosure, the surface coating of the component has a thickness of at least 0.01 inch, and robotic polishing of the surface of the ceramic coating is limited to the removal of only 0.0005 to 0.00075 inch of ceramic material.

In accordance with a still further aspect of the present disclosure, the force of the robotically applied brush against the component is limited by the force sensing controller to not exceed 5 pounds of force, and the time required to complete the polishing of the component is less than three minutes.

In accordance with yet another aspect of the present disclosure, a method of achieving a predetermined surface finish on a ceramic coated aerospace component including an outer surface layer of ceramic includes robotically applying a diamond brush to the outer surface layer, wherein the brush is configured to achieve a finish of 100 microinches $R_a$ or less on the outer surface layer.

In accordance with yet another aspect of the present disclosure, a gas turbine component has an outer coating of ceramic, and the outer coating has a surface finish of 100 microinches $R_a$ or less. The surface finish is formed by a robotically applied diamond impregnated brush applied against the surface at a force that does not exceed 5 pounds, and the robotically applied brush is configured to limit removal to only 0.0005 to 0.00075 inch of ceramic material.

Further forms, embodiments, features, advantages, benefits, and aspects of the present disclosure will become more readily apparent from the following drawings and description provided herein.

It is to be appreciated that the drawings may be limited, not to scale, and/or otherwise less than fully exemplary of all envisioned and/or potential embodiments of the disclosure contained herein. As such, the following detailed description is not intended to limit the disclosure or its applications and uses. In this regard, it is to be further appreciated that the described embodiments may have numerous equivalents, and/or can be implemented in various other systems and environments that are not described nor shown.

DETAILED DESCRIPTION

For simplicity and illustrative purposes, the principles of the disclosure are described by referring to an embodiment thereof. As used herein, the terms "article" and "component" refer to an object being worked on with a machining or polishing tool such as a rotary brush. The term "diamond brush" refers to a brush containing any herein defined abrasive materials that may be employed for polishing, such as and including diamond impregnated bristles. The term "robotic" refers to any or automatic or non-manual operation, such as and including any autonomous operation. The designation "RA" refers to "roughness average" of a surface, and is herein stated in microinches, wherein 1 microinch equals 0.0254 microns. Further, the term "high pressure turbine vane" means both a final turbine vane product and an intermediate turbine vane product that has either been or will be finish machined to make the final turbine product.

Figure 1:
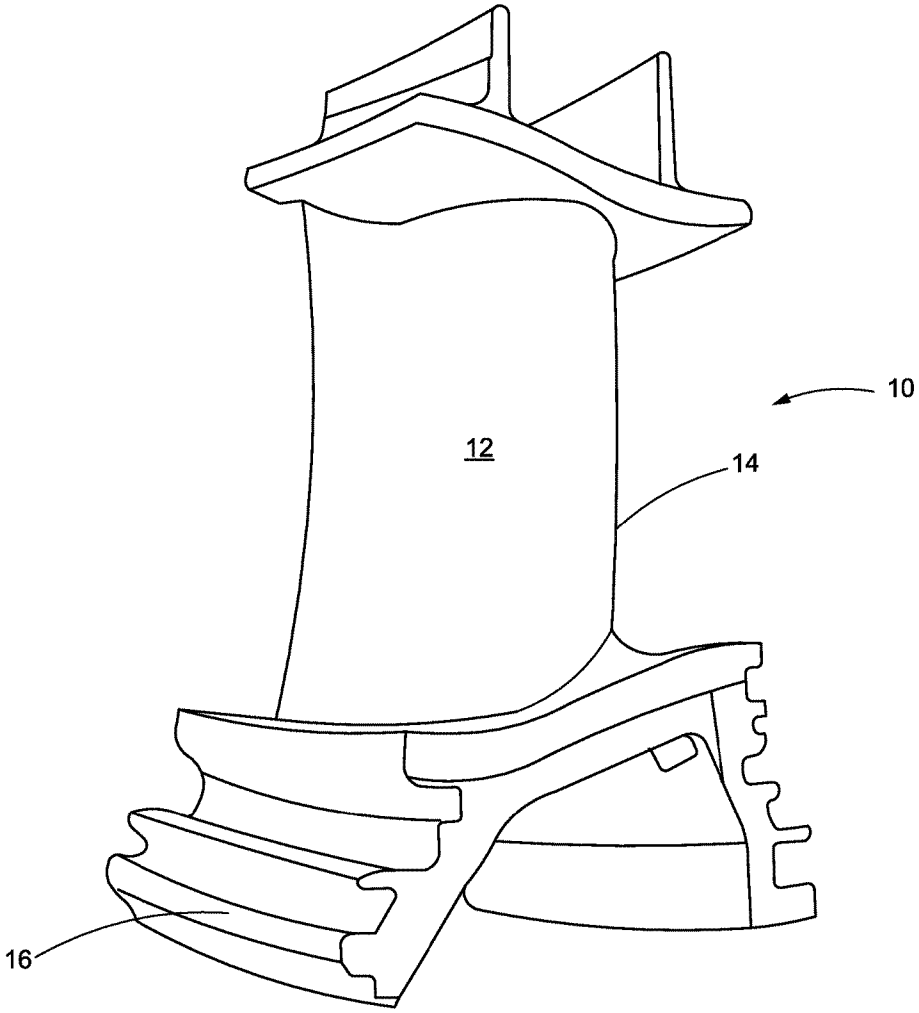
FIG. 1 is a perspective view of a gas turbine engine component constructed in accordance with the teachings of this disclosure.

Referring now to the drawings with initial reference to FIG. 1, an exemplary component, such as a high pressure gas turbine vane, 10 is shown in a partial fragmentary view. Such component, or gas turbine vane, 10 is but one exemplary aerospace component that may be utilized in a high-pressure hot section of a modern turbojet engine (neither shown), as may be fully appreciated by those skilled in the art.

The turbine vane 10 includes an outer layer of ceramic, depicted as a coated ceramic layer 12. The ceramic layer 12 acts as a thermal barrier for enhancing longevity of the turbine vane 10, which would otherwise be directly exposed to an intensely hostile environment of high pressure and heat within a hot section of the turbojet engine. Temperatures within the environment of the hot section may approach 2,000 degrees Celsius. The coated ceramic layer 12 may be applied to the turbine vane 10 by plasma spray techniques.

Once applied, the exterior surface 14 of the coated ceramic layer 12 is polished so as to reduce frictional heat produced by the voluminous mass of combustion gases that flow over the exterior surface 14. As such, any unnecessary friction produces even greater heat loads, along of course with commensurate rises in operating temperatures.

In the disclosed embodiment, the turbine vane 10 includes static or positionally fixed vanes 16 for directing the flow of combustion gases to turbine blades within the hot section, thereby rotationally propelling the turbine blades. Those skilled in the art will appreciate that the turbine vane 10 is only one example of a gas turbine engine component that may be ceramic coated in accordance with this disclosure.

Figure 2:
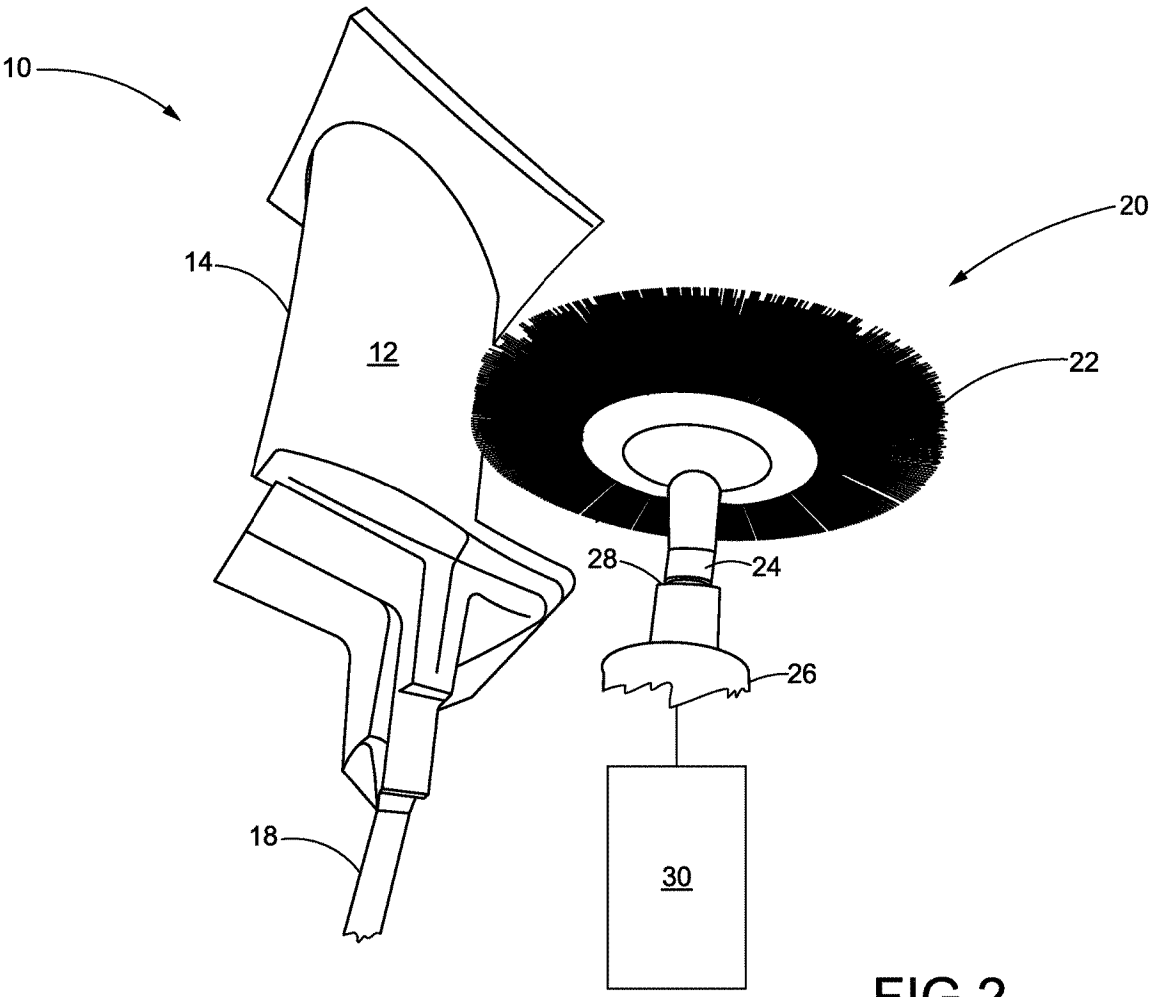
FIG. 2 is a fragmentary perspective view of the component of FIG. 1 during a polishing process conducted in accordance with the present disclosure.

Referring now to FIG. 2, a method of polishing a turbine hot section component according to the present disclosure involves a robotically actuated rotary diamond brush 20 employed to conduct an effective time-saving polishing operation on the turbine vane 10. As depicted, the turbine vane 10 is shown supported on a schematically depicted machine fixture 18. Any given force of the diamond brush 20, which contains diamond impregnated bristles 22, as applied against the exterior surface 14 of the component 10, is limited via the use of a force sensing controller. The diamond brush 20 includes a rotary head 24 which may be attached to a robotic arm 26, and movable about a robotic joint 28. A force sensing controller 30, shown schematically, may be programmed to provide control inputs adapted to reduce amount of force applied against the exterior surface 14 of the turbine vane 10 to a range of 4 to 5 pounds. Alternatively, while some coated layers (such as an applied APPS coated ceramic layer 12) can work successfully up to 5 pounds of force, other coatings may require more force to successfully control final surface finishes, for example, up to 15 pounds.

While the diamond brush 20 may be movable about the robotic joint 28, as described above, alternative methods may include holding the brush in a stationary location, while placing the component 10 on an end of a moveable robotic arm 26, with a force sensor (as part of the controller 30) situated between the arm 26 and the component 10. The force sensor may be configured as part of a pneumatic head or spring loaded device, and may by way of example be either passive or active, and/or may include strain gage elements (not shown).

Finally, power consumption requirements for operation of the diamond brush 20 may fall within a range of 10 to 50 watts. The amount of physical time required to polish each individual component 10 will depend of course on component size, and actual dimensions of the surface desired to be polished.

EXAMPLE

In at least one embodiment, a ceramic coated component, i.e. the turbine vane 10, was polished to achieve a final surface finish having a roughness average ($R_a$) of approximately 100, and/or at least less than 150, microinches. The ceramic layer 12 was applied via plasma spray to a thickness of approximately 0.01 inch. A 6 inch diameter robotically actuated rotary diamond brush 20 was employed at a rotational speed of 2500 RPM. The diamond brush 20 contained diamond impregnated bristles 22, the bristles having been formed of nylon, with diamond particles having been extruded into a nylon base material. The amount of force against the exterior surface 14 of the ceramic layer 12 was limited to 5 pounds to avoid undesirable degradation of the exterior surface 14. The amount of material removed by the diamond brush 20 was only 0.0005 to 0.00075 inch of ceramic material to achieve an RA within the range of 100 to 150 microinches. Several parts were completed, averaging approximately 2 minutes per part, and thus saving over 50% of actual polishing time required using previous methods of abrasive particles in a water bath. The time savings did not include the additional time required for transfer of parts and cleanup of slurry baths between batches.

The polishing method as presented herein has been disclosed only in the context of using the above-described diamond material. However, it may be appreciated by those skilled in the art that although diamond, whether natural or synthetic, is the hardest of all known materials, the use of other so-called superabrasives such as synthetic cubic boron nitride (CBN) may be employed. In some instances, such superabrasive materials may be used either singly or in some combination. As such, any ceramic coated article described herein may be polished via superabrasive materials comprising natural diamond, synthetic diamond, cubic boron nitride (CBN), or some combination thereof.

In summary, a turbine engine hot section component may be polished by the described process to achieve improved efficiency, shortened processing time, and reduced cost. As such, the turbine engine component may demonstrate comparable, if not superior, performance in comparison to components formed under previous methods. Gas turbine engine components utilizing such polishing of their outer coated ceramic surfaces can therefore achieve improved manufacturing efficiencies and lower overall costs.

INDUSTRIAL APPLICABILITY

The present disclosure describes a polishing method that may find applicability in aerospace and industrial gas turbine environments. The method may find applicability in numerous applications including, but not limited to, specific applications involving hot sections of gas turbine engines.

There are a number of benefits obtained by the process of this disclosure. Conventional manufacturing processes to produce ceramic coated components are time-consuming, expensive and limited by certain traditional process parameters. Current demand to make irregularly-shaped turbine engine hot section components may often exceed capacity of conventional manufacturing processes. Via the use of superabrasive rotary brush polishing techniques, the present disclosure may enable an efficient and more effective process of polishing turbine engine components for gas turbine engines, and avoiding the current time-consuming, messy, abrasive particle and water vibratory bath processes. Accordingly, the present disclosure opens up new possibilities for polishing gas turbine engine components which have heretofore been limited to conventional methods.

While the disclosure has been presented in reference to only certain embodiments, it will be understood by those skilled in the art that various changes may be made to, and equivalents substituted for, the disclosed elements without departure from scope of the disclosure. Therefore, the disclosure should not be limited to only the particular embodiments disclosed, but should instead include all embodiments falling within the scope of the appended claims.

What is claimed is:

1. A method of polishing an exterior surface of a ceramic coated outer layer of an aerospace component, the outer layer having a thickness of at least 0.01 inch; the method comprising:

robotically applying an abrasive brush to the exterior surface, wherein the brush is configured to achieve a finish of 100 microinches $R_a$ or less on the exterior surface and wherein the abrasive brush is configured to remove 0.0005 to 0.00075 inch of ceramic material and after polishing the surface has an average surface roughness, $R_a$, of 150 microinches or less.

2. The method of polishing the exterior surface of claim 1, wherein the brush comprises bristles impregnated with abrasive material affixed to a rotary head.

3. The method of polishing the exterior surface of claim 1, wherein motion of the brush relative to the component is subject to a force sensitive controller and the motion of the brush relative to the component has a force which is relative to the ceramic coated outer layer.

4. The method of polishing the exterior surface of claim 1, wherein the component is an airfoil including vanes.

5. The method of polishing the exterior surface of claim 1, wherein the coating provides a thermal barrier for maintaining integrity of the component in an environment having temperatures ranging up to 2,000 degrees Celsius.

6. The method of polishing the exterior surface of claim 1, wherein the surface coating of the component has a thickness of approximately 0.01 inch and after polishing the surface has an average surface roughness, $R_a$, of 100 microinches or less.

7. The method of polishing the exterior surface of claim 1, wherein the abrasive brush comprises diamond impregnated bristles.

8. The method of polishing the exterior surface of claim 1, wherein the aerospace component is a gas turbine engine component.

9. The method of polishing the exterior surface of claim 1, wherein the surface coating of the component has a thickness of approximately 0.01 inch and after polishing the surface has an average surface roughness, $R_a$, of 100 to 150 microinches.

10. A method of achieving a predetermined surface finish on a ceramic coated aerospace component, the component including an outer surface layer of ceramic, the outer layer having a thickness of at least 0.01 inch; the method comprising:

robotically applying an abrasive brush to the outer surface layer, wherein the brush is configured to achieve a finish of 100 micro inches $R_a$ or less on the outer surface layer and wherein the abrasive brush is configured to remove 0.0005 to 0.00075 inch of ceramic material by polishing; and after polishing the outer surface layer has an average surface roughness, $R_a$, of 150 microinches or less.

11. The method of achieving the predetermined surface finish on the ceramic coated component of claim 10, wherein the brush comprises bristles impregnated with abrasive material affixed to a rotary head.

12. The method of achieving the predetermined surface finish on the ceramic coated component of claim 10, wherein motion of the brush relative to the component is subject to a force sensitive controller and the motion of the brush relative to the component has a force which is relative to the ceramic coated outer layer.

13. The method of achieving the predetermined surface finish on the ceramic coated component of claim 10, wherein the component is an airfoil including vanes.

14. The method of achieving the predetermined surface finish on the ceramic coated component of claim 10, wherein the coating provides a thermal barrier for maintaining integrity of the component in an environment having temperatures ranging up to 2,000 degrees Celsius.

15. The method of achieving the predetermined surface finish on the ceramic coated component of claim 10, wherein the surface coating of the component has a thickness of approximately 0.01 inch.

16. The method of achieving the predetermined surface finish on the ceramic coated component of claim 10, wherein the abrasive brush comprises diamond impregnated bristles.

17. The method of achieving the predetermined surface finish on the ceramic coated component of claim 10, wherein the component is a gas turbine engine component.

18. The method of achieving the predetermined surface finish on the ceramic coated component of claim 10, wherein the outer layer of the component has a thickness of approximately 0.01 inch and after polishing the surface has an average surface roughness, $R_a$, of 100 to 150 microinches.

* * * * *